United States Patent [19]

Otsuka et al.

[11] Patent Number: 4,934,341

[45] Date of Patent: Jun. 19, 1990

[54] THROTTLE ACTUATOR OF INTERNAL COMBUSTION ENGINE

[75] Inventors: Hiroshi Otsuka; Shigeo Tamaki, both of Katsuta, Japan

[73] Assignee: Hitachi, Ltd., Tokyo, Japan

[21] Appl. No.: 259,533

[22] Filed: Oct. 18, 1988

[30] Foreign Application Priority Data

Oct. 28, 1987 [JP] Japan ..... 62-270456

[51] Int. Cl.[5] ..... F01P 1/06

[52] U.S. Cl. ..... 123/41.31; 123/361; 310/54

[58] Field of Search ..... 123/41.31, 361; 251/129.11, 129.12; 137/340; 310/54

[56] References Cited

U.S. PATENT DOCUMENTS 4,002,185 1/1977 Konczal ..... 251/129.11
4,739,204 4/1988 Kitamura et al. ..... 123/41.31

FOREIGN PATENT DOCUMENTS 5825853 5/1983 Japan .
6023238 2/1985 Japan .
62-197649 9/1987 Japan .

*Primary Examiner*—Noah P. Kamen
*Attorney, Agent, or Firm*—Antonelli, Terry, Stout & Kraus

[57] ABSTRACT

A throttle actuator for controlling a throttle valve disposed in the intake passage of an internal combustion engine in accordance with a signal representing the throttle opening demand. The throttle actuator has a rotary type acutator motor and a coolant pipe arranged in a portion of the actuator motor or in the vicinity of the actuator motor so that heat generated in the actuator motor is effectively absorbed by coolant which branches from the engine coolant line. The rotary type actuator motor can stably operated even under severe environment condition so as to prevent any decrease in the output torque and ensure improved precision and safety in the control of opening of the throttle valve.

3 Claims, 3 Drawing Sheets

THROTTLE ACTUATOR OF INTERNAL COMBUSTION ENGINE

BACKGROUND OF THE INVENTION

1. Field of the Invention

The present invention relates to a throttle actuator for use in an internal combustion engine and, more particularly, to a throttle actuator making use of a motor having a rotatable output shaft.

2. Description of the Prior Art

In the field of automotive internal combustion engines, there is a trend for realization of electronic control of throttle valve.

The electronic control of throttle valve generally employs a throttle actuator incorporating, for example, a stepping motor which is controlled in accordance with a throttle opening signal representing the instant degree of operating of the accelerator, thereby conducting feedback control of the opening of the throttle valve under various conditions. The electronic control of throttle valve is expected to provide various advantages such as higher fuel economy and cleaning of exhaust gases, through improvement in the precision of control of the throttle valve opening.

An electronic throttle control device of this kind is disclosed, for example, in Japanese Examined Patent Publication No. 58-25853. Another type of electronic throttle control device has also been known in which the opening of the throttle valve is controlled by means of a solenoid. An example of the electronic throttle control device of this type is shown, for example, in Japanese Unexamined Utility Model Publication No. 60-23238. In this device, the solenoid is cooled by engine coolant which is circulated through the engine.

In general, the temperature in the engine room is variable over a very wide range, from about −30° C. up to 100° C., which is experienced from the time that the engine is not operating while the automobile is used in a cold season to a time when the engine is operating in a high load while the automobile is used in a hot season. When a motor is used as the actuator for electronic throttle control system, the inside temperature of the motor rises to a level which is still higher than the temperature of air in the engine compartment, due to the heat of this air and the heat generated by the motor itself. When the air temperature in the engine compartment is high, therefore, it is often experienced that the throttle actuator motor is overheated to a level which exceeds the maximum allowable temperature. In such a case, the impedance of the coil in the motor is increased so that the output of the throttle actuator is reduced with the result that the throttle valve cannot be actuated properly.

The same problem is encountered also with the case where the electronic throttle control system employs a solenoid as the actuator. Namely, the solenoid tends to be overheated due to high temperature of air in the engine compartment so that the output power is decreased to impair correct movement of the throttle valve, and this is the reason why the solenoid is cooled by the engine cooling water as explained above. Another problem encountered with the electronic solenoid control system employing a solenoid-type actuator is that the control of intake air is possible only when the air flow rate is comparatively small due to restriction in the power of the solenoid, e.g., only when the engine is operating at a comparatively low speed of about 3,000 rpm or so. When the function of the actuator is impaired due to a rise in the temperature of the air in the engine compartment, the movement of the throttle valve is seriously affected by the intake vacuum.

In contrast, a throttle actuator of stepping motor type can produce a force which is large enough to control the intake air flow rate up to, for example, 8,000 rpm in terms of engine speed. Thus, the throttle actuator of stepping motor type can be used over wide range. It is also to be pointed out, however, that the magnet of the stepping motor, which is usually made of a ferrite alloy or an AL-Ni-Co alloy, exhibits a reduction in the magnetic power when its internal temperature exceeds a certain level. Thus, the torque of the stepping motor decreases in the condition through the point of contrary flexure where the magnet temperature exceeds about 120° C. In such a case, since the stepping motor itself has no function for data concerning the rotational position of its rotor, the throttle opening is drastically decreased to restrict the flow of intake air to the same level as that in idle state of the engine. This phenomenon, usually referred to as "out-of-step", directly affects the running speed of the automobile and, hence, the safety of the passenger on the automobile, due to drastic closing of the throttle valve. From this point of view, the control of temperature of the throttle actuator motor is a very critical problem. Unfortunately, however, no proposals have been made for the control of the temperature of the stepping motor used in the throttle actuator.

SUMMARY OF THE INVENTION

Accordingly, an object of the present invention is to make it possible to effectively cool a motor of rotary type used as a throttle actuator with a simple cooling means, so as to prevent any reduction in the power of the throttle actuator so as to ensure a higher accuracy and safety in the throttle control of internal combustion engines.

To this end, according to the present invention, a coolant passage is arranged in the vicinity or the part of the stepping motor used as the throttle actuator and a part of the engine coolant is introduced into this coolant passage so as to absorb heat generated in the stepping motor.

During operation of the engine, the temperature of the stepping motor used as the throttle actuator rises to a high level due to the heat from the air in the engine compartment and the due to the heat produced by the stepping motor. According to the invention, however, the heat is effectively absorbed by the coolant which is circulated through the coolant passage arranged in the vicinity of the stepping motor so that the temperature rise of the motor coil is maintained below the allowable level which does not adversely affect the performance of the motor. Consequently, the tendency for the impedance of the motor coil to rise is suppressed to ensure the safe operation of the throttle actuator, i.e., the output torque of the throttle actuator motor.

DESCRIPTION OF THE PREFERRED EMBODIMENTS

Figure 1:
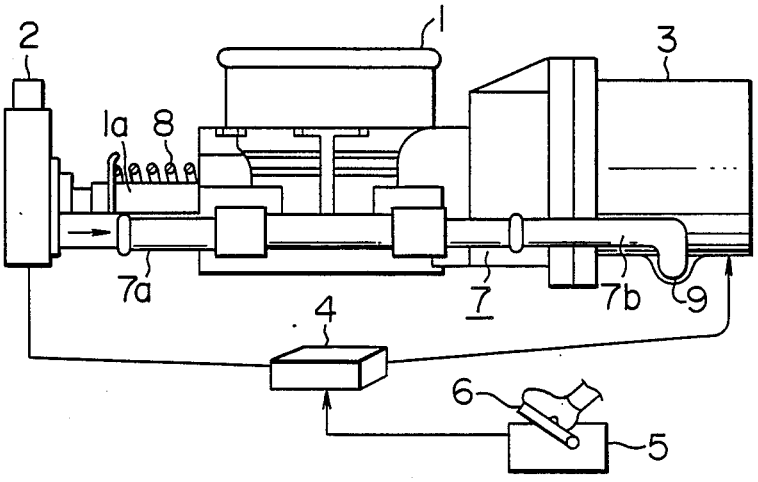
FIG. 1 is a schematic illustration of a first embodiment of the electronic throttle control device in accordance with the present invention.

Referring to FIG. 1, a throttle sensor 2 is connected to the shaft 1*a* of a throttle valve (not shown) which is disposed in a throttle body 1. Thus, the throttle valve is capable of detecting the degree of opening of the throttle valve by the throttle sensor 2. The shaft 1*a* of the throttle valve also is drivingly connected to a stepping motor 3 which serves as a throttle actuator. More specifically, as will be understood from FIG. 2, the stepping motor 3 is composed of a motor coil 3*a* and a rotor 3*b* having the output shaft 3*c* connected to the shaft 1*a* of a throttle valve through a reduction gear disposed in the throttle body 1.

The operation of the throttle valve is conducted under the control of a throttle control circuit 4. A coolant pipe 7 is composed of a first pipe section 7*a* mounted in contact with the side wall of the throttle body 1 and a second pipe section 7*b* connected to the first pipe section 7*a* and mounted in contact with the body of the stepping motor 3. The coolant pipe 7 is communicated with the engine coolant line so that a part of the coolant is circulated through the coolant pipe 7. The first pipe section 7*a* is intended for warming the throttle body 1 by the heated engine coolant so as to avoid icing of the throttle valve when the automobile is used in a cold district, while the second pipe section 7*b* is intended for absorbing heat generated by the stepping motor 3. A return spring 8 is fixed to the shaft 1*a* of the throttle valve and is capable of producing a force greater than the friction in the motor 3 so as to forcibly return the throttle valve when the accelerator pedal 6 is released.

In operation, an accelerator opening detector 5 detects the state of the accelerator pedal 6, that is, the amount of pressing of the accelerator pedal 6, and the control circuit 4 computes the throttle opening degree corresponding to the amount of pressing of the accelerator pedal 6 and outputs the signal of the throttle opening degree. The stepping motor 3 is driven and controlled in accordance with the throttle opening degree signal so as to actuate the throttle valve to any desired degree of opening. At the same time, the position of the throttle valve is confirmed by the throttle sensor 2 and is fed back to the control circuit 4 so that a closed control loop is formed so as to conduct a feedback control of the throttle valve.

Figure 3:
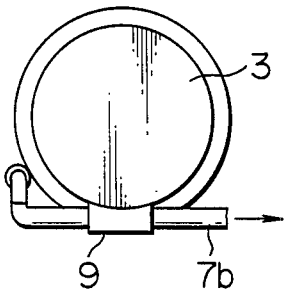
FIG. 3 is a side elevational view of portion of the first embodiment.
Figure 6:
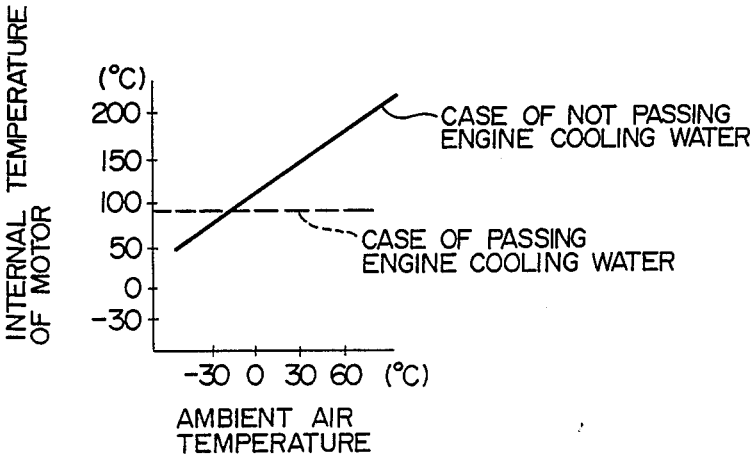
FIG. 6 is a graphical illustration the relationship between air temperature around a motor used as a throttle actuator and the temperature inside the motor.
Figure 7:
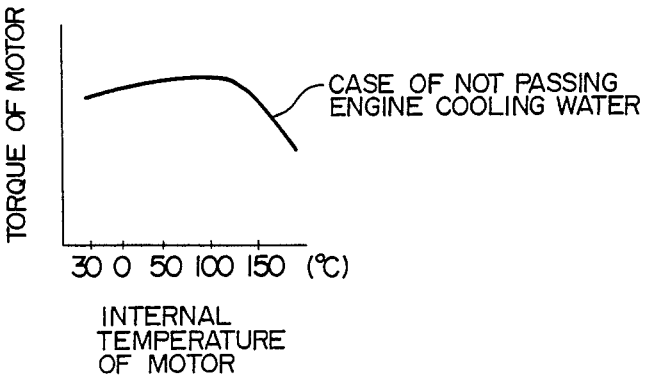
FIG. 7 is a graphical illustration the relationship between the temperature inside the throttle actuator motor and the output torque of the throttle actuator motor.

During the operation of the internal combustion engine, the temperature of air in the engine compartment is raised as explained before, and, at the same time, the stepping motor 3 itself generates heat, so that the internal temperature of the stepping motor 3 is raised to a level above the temperature of air in the engine compartment. In fact, the temperature inside the motor well exceeds 100° C. when no countermeasure is taken. Referring to FIG. 6, the solid line curve shows the relationship between the temperature inside a conventional stepping motor and the ambient air temperature. It will be seen that the temperature inside the stepping motor well exceeds 100° C. due to the high temperature of air in the engine compartment and the heat generated by the stepping motor itself, provided that the ambient air temperature is substantially above 0°. In general, when the temperature inside the stepping motor 3 exceeds about 100° C., the output torque of the stepping motor 3 is drastically decreased due to an increase in the impedance of the motor coil, as will be seen from FIG 7. Such a problem would be overcome by providing a suitable measure for cooling the stepping motor 3. A coolant pipe 7*a*, attached to the wall of the throttle valve for the purpose of preventing the icing of the throttle valve, is insufficient to provide the required cooling effect on the stepping motor. In this embodiment, therefore, a pipe joint portion 9 is provided on a portion of the body of the stepping motor 3 as shown in FIG. 3, and the second coolant pipe section 7*b* is connected to the pipe joint portion 9. Thus, the coolant is supplied from the engine coolant line, through the first coolant pipe section 7*a* and the second coolant pipe section 7*b*. In general, the temperature of engine coolant ranges between 80° C. and 90° C. during normal operation of internal combustion engine. Therefore, the coolant still has an ability to effectively cool the stepping motor 3, so that the temperature of the stepping motor is maintained substantially at the same level as the temperature of the engine coolant, i.e., at a level well below 100° C. which approximates the maximum allowable temperature of the stepping motor 3. In FIG. 6, the broken-line curve shows the characteristic of the temperature inside the stepping motor 3 as observed when the stepping motor is cooled by the engine coolant passed through these as in the described embodiment. It will be seen in the diagram of FIG. 6 that the temperature inside the stepping motor 3 is maintained substantially constant regardless of the ambient air temperature. Consequently, the motor coil 3*a* in the stepping motor 3 is effectively cooled so as to prevent any increase in the impedance of the motor coil so that the stepping motor 3 can maintain an output torque in a steady state.

As will be understood from the foregoing description, in the described embodiment of the present invention, the output characteristic of the throttle actuator in relation to temperature can be maintained at a practical level despite the severe condition of use so as to enhance the precision of control while preventing accident attributable to any control failure, whereby the realibility of the throttle control device as a whole and, hence, the safety of automobile passengers can be improved.

It is also to be understood that this remarkable effect can be achieved by a simple additional measure, i.e., merely by addition of a coolant pipe branching from engine coolant line. Thus, the reliability of the throttle actuator can remarkably be improved by a cooling system of a very simple construction.

Figure 2:
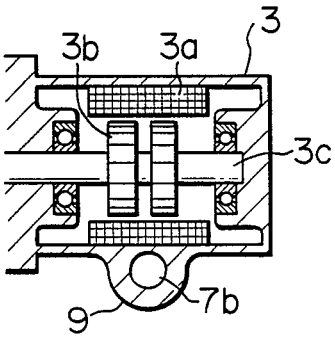
FIG. 2 is a sectional view of a portion of the first embodiment.
Figure 4:
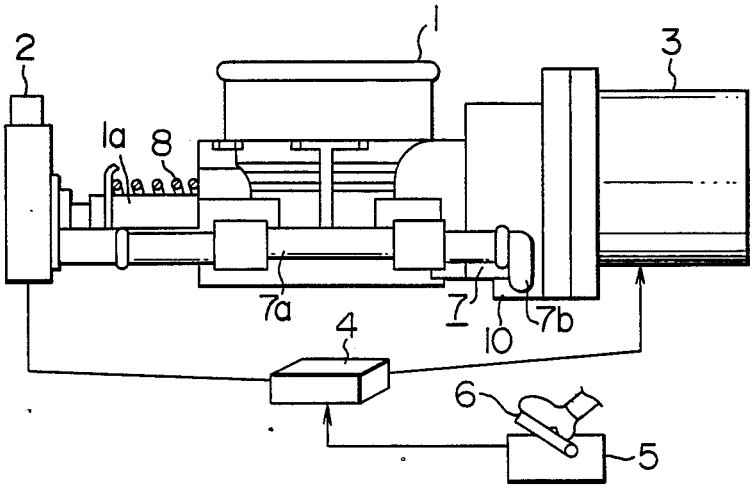
FIG. 4 is a schematic illustration of a second embodiment of the present invention.
Figure 5:
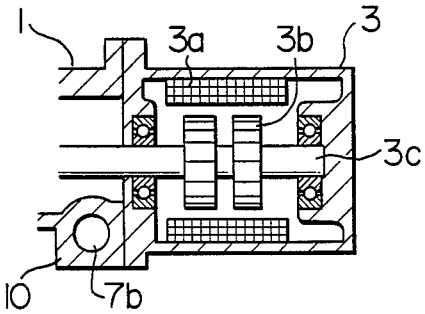
FIG. 5 is a sectional view of a portion of the second embodiment.

In FIGS. 4 and 5, the same reference numerals are used to denote the same parts or members as those in the first embodiment, and the embodiment of FIGS. 4 and 5 is distinguished from the embodiment of FIGS. 1–3 in that the second coolant pipe section 7*b* is not directly attached to the body of the stepping motor 3 but is mounted on a portion of the throttle body 1 in the vicinity of the stepping motor 3 through a pipe mount 10, as shown in FIG. 5. It will be understood that such a coolant pipe also effectively absorbs the heat of the stepping motor 3 by the engine coolant, as in the embodiment of FIGS. 1–3.

Although in the described embodiments stepping motors are used as the throttle actuator, this is only illustrative and the throttle actuator may be composed of other types of device such as, for example, a D.C. motor having a rotational output shaft.

As has been described, according to the present invention, the motor of rotary type used as the throttle actuator can be efficiently cooled by a coolant system which can be constructed simply and easily by making use of the coolant which is circulated through the engine, so that abnormal reduction in the output torque of the motor is avoided despite severe environment condition of use, thereby improving the precision and reliability in the control of the throttle valve.

What is claimed is:

1. A throttle actuator of an internal combustion engine comprising:

a rotary stepping type actuator motor means for controlling the opening of a throttle valve provided in an intake passage of said internal combustion engine in accordance with a signal representing a throttle opening demanded by said internal combustion engine, and a coolant passage means provided at a portion of a body of said rotary type actuator motor means for circulating a part of a coolant circulated through a coolant system of said internal combustion engine so that heat generated in said rotary stepping type actuator motor means is absorbed by the coolant circulated through said coolant passage means.

2. A throttle actuator according to claim 1, wherein said coolant passage means includes a coolant pipe section mounted in the body of said rotary stepping type actuator motor means.

3. A throttle actuator according to claim 1, wherein said coolant passage means includes a coolant pipe mount means mounted on the body of said rotary stepping type actuator motor means.

* * * * *